United States Patent [19]

Kasboske

[11] Patent Number: 4,839,779

[45] **Date of Patent: * Jun. 13, 1989**

[54] MULTIPLE COLOR LIGHT WITH STRUCTURE TO PREVENT COLOR BLEEDING

[75] Inventor: George C. Kasboske, Chicago, Ill.

[73] Assignee: Quintech Corporation, Chicago, Ill.

[ * ] Notice: The portion of the term of this patent subsequent to Dec. 15, 2004 has been disclaimed.

[21] Appl. No.: 129,841

[22] Filed: Dec. 8, 1987

[51] Int. Cl.[4] ..... F21V 9/00

[52] U.S. Cl. ..... 362/214; 362/231; 362/293; 362/298

[58] Field of Search ..... 362/211, 212, 214, 231, 362/293, 298, 304; 313/112

[56] References Cited

U.S. PATENT DOCUMENTS

| | | | |
|---|---|---|---|
| 1,262,394 | 4/1918 | Schickerling | 362/214 |
| 1,374,344 | 4/1921 | Williams | 362/212 X |
| 1,460,511 | 7/1923 | Richardson | 362/214 |
| 1,649,975 | 11/1927 | Parks | 362/214 X |
| 1,666,876 | 4/1928 | Price | 362/214 X |
| 1,923,181 | 8/1933 | Albers | 362/214 |
| 1,998,157 | 4/1935 | Fossum, Jr. | 362/212 X |
| 4,644,452 | 2/1987 | Kasboske | 362/214 |
| 4,713,736 | 12/1987 | Kasboske | 362/214 |

*Primary Examiner*—Ira S. Lazarus
*Assistant Examiner*—Richard R. Cole
*Attorney, Agent, or Firm*—Wood, Dalton, Phillips, Mason & Rowe

[57] ABSTRACT

A light apparatus has a first source of light, a first surface for causing light transmitted therethrough from the first source to have a first color, a second source of light, a second surface for causing light transmitted therethrough from the second source to have a second color, and a coating on the second surface to prevent light from the first source that is transmitted through the first surface from passing through the second surface.

16 Claims, 1 Drawing Sheet

FIG. 1
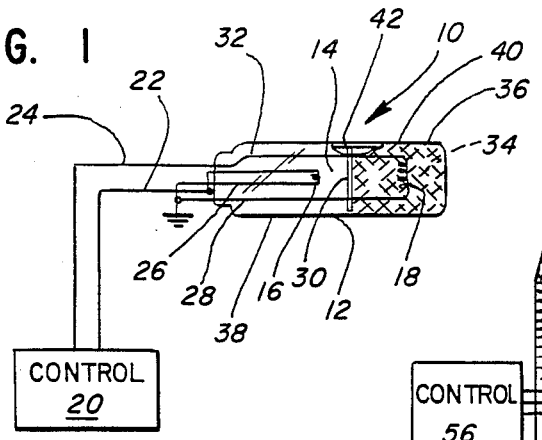
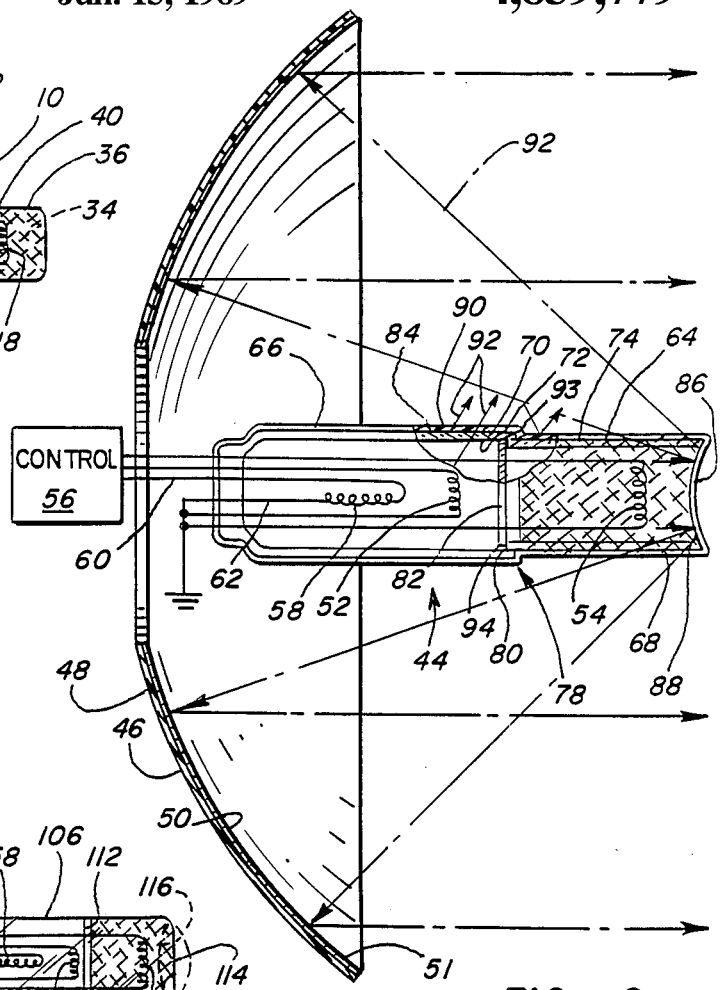
FIG. 2
FIG. 3
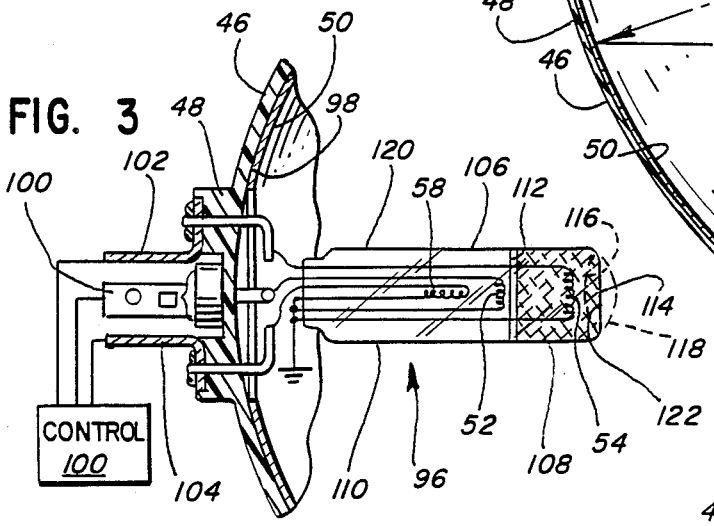
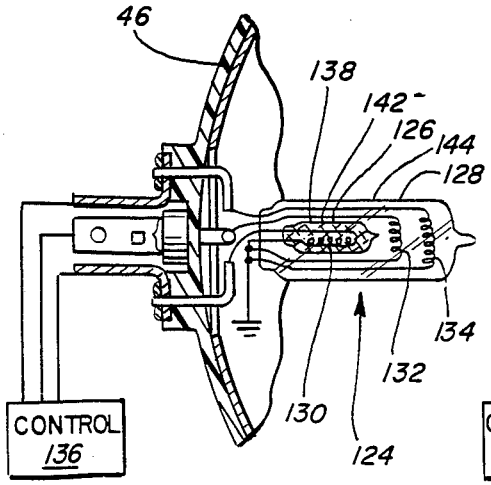
FIG. 4
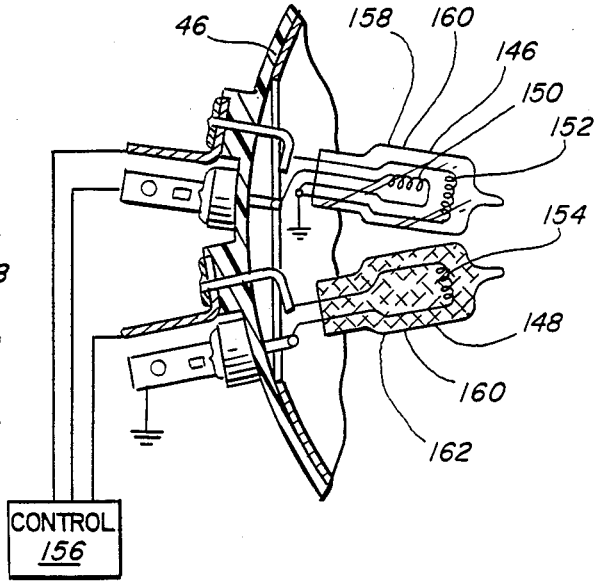
FIG. 5

MULTIPLE COLOR LIGHT WITH STRUCTURE TO PREVENT COLOR BLEEDING

BACKGROUND OF THE INVENTION

1. Field of the Invention

This invention relates to an apparatus for projecting light selectively from separate sources through different color light transmission surfaces and, more particularly, to structure for preventing light projected through one of the transmission surfaces from passing through another of the transmission surfaces.

2. Background Art

It is known to provide a bulb with different color light transmission surfaces and separate, selectively operable filaments to project light through those surfaces and thereby produce, at one's desire, different color light. Such a bulb is shown, for example, in FIG. 3 of my U.S. Pat. No. 4,644,452. It is also known to use separate bulbs, each with a different color light transmitting surface, to project light against a common reflector, as also seen in my U.S. Pat. No. 4,644,452 in FIGS. 4 and 5. These structures are quite versatile and have proven very effective for their intended purposes.

However, one problem that has been encountered is that there may be some bleeding of light from one of the bulb surfaces through another of the bulb surfaces when the filament associated with the other bulb surface unpowered. The result is that the light color produced is not clean, i.e. there is mixture of different light colors resulting from the different color light transmission surfaces. This is particularly a problem where the bulb is associated with a reflector which directs light projecting from the one transmission surface back towards another transmission surface.

SUMMARY OF THE INVENTION

The present invention has as its objective to overcome the problem noted above and provide sharp division of light color.

According to the invention, a lighting apparatus is provided which has a first source of light, a first surface for causing light transmitted therethrough from the first source to have a first color, a second source of light, a second surface for causing light transmitted therethrough from the second source to have a second color, and a coating on the second surface to prevent light from the first source that is transmitted through the first surface from passing through the second surface.

Accordingly, light can be transmitted through the first and second surfaces in only one direction i.e. from each light source outwardly through its associated surface. The invention comprehends a general purpose lighting apparatus, which can be used with or without a reflector. When used with a reflector, the lighting apparatus can serve as a versatile vehicle headlamp.

In most applications, and particularly in the case of a vehicle headlamp, the first and second surfaces are preferably part of a cylindrical bulb and arranged in axially spaced relationship extending away from a concave reflective surface on the headlamp, which opens towards the light sources.

The invention also contemplates the provision of a convex reflective surface on the bulb conforming generally to the curvature of and spaced remotely from the concave reflector. This convex surface reflects light from its associated source back to the reflector to increase the intensity of the light from the reflector.

Preferably, a light blocking baffle is mounted between the first and second light sources to prevent direct transmission of light from the first source through the second surface and the second source through the first surface.

To facilitate manufacture of the inventive structure, preferably the first and second surfaces are defined by separate bulbs. Each bulb has a cylindrical portion. The first and second bulbs are joined to each other by inserting the cylindrical portions in axial overlapping relationship, one within the other, and thereafter fusing the bulbs in well known manner.

By selectively powering the first and second sources, a light transmitted through each of the first and second surfaces is clean, i.e. unaffected by the surface associated with the unpowered source(s).

BRIEF DESCRIPTION OF THE DRAWINGS

FIG. 1 is an elevation view of a light according to the present invention;

FIG. 2 is an elevation view of a modified form of light according to the present invention;

FIG. 3 is an elevation view of another modified form of light according to the present invention;

FIG. 4 is an elevation view of a further modified form of light according to the present invention; and FIG. 5 is an elevation view of a still further modified form of light according to the invention.

DETAILED DESCRIPTION OF THE DRAWINGS

In FIG. 1, a general purpose light is shown at 10 in accordance with the present invention. The light 10 consists of a generally cylindrical bulb 12 which may be made from glass or other light transmitting material. The bulb is formed in one piece and defines an internal chamber 14 within which first and second light producing filaments 16, 18 are provided in axially spaced relationship. The filaments 16, 18 are selectively powered by a conventional control 20, shown schematically in FIG. 1. The control 20 is operable to permit powering of one of the filaments 16, 18 independently of the other and also can be provided with a rheostat to control the intensity of light from the filaments 16, 18. Wire leads 22, 24 connect the filaments 16, 18, respectively, to the control 20. Wires 26, 28 connect the filaments 16, 18, respectively, to ground.

There is a disc-shaped baffle 30 provided within the chamber 14 to divide the chamber 14 into axially spaced left and right chamber portions 32, 34, respectively, in FIG. 1. The baffle 30 prevents transmission of light from filament 16 into chamber portion 34 and filament 18 into chamber portion 32. The bulb 12 has a surface 36 through which light from the filaments 16, 18 is transmitted. That portion 38 of the surface 36 axially to the left of the baffle 30 in FIG. 1 is clear. That portion 40 of the surface 36 axially to the right of baffle 30 in FIG. 1 is colored. Accordingly, with filament 16 powered, the light transmitted through surface portion 38 is white light and light from filament 18 transmitted through surface portion 40 has a color dictated by the color of the surface portion 40. The invention contemplates that the surface portions 38, 40 can be any color, so long as the colors are different, and the clear and colored arrangement shown in FIG. 1 is only exemplary. For example, surface portion 38 could be colored green and surface portion 40 red or surface portion 40 could be clear and surface portion 38 colored.

The present invention has as one of its objectives to prevent light that is transmitted through bulb portion 38 from passing through bulb portion 40 and vice versa. This bleeding of light from one portion 38, 40 into the other portion 38, 40 prevent a sharp division of light colors and is therefore undesirable. To obviate this problem, a light reflective coating 42 is deposited on at least one of the surface portions 38, 40 to thereby permit only one-way light transmission—that is, light can only pass through surface 36 outwardly from the chamber 14. In the event that one of the surface portions 38, 40 is clear, the coating need not be applied thereon. Suitable coatings are well known. For example, a suitable coating is commonly used on one-way mirrors and sunglasses. A mercury-like coating is preferred. The coating may be heavy silver or quick silver. It should be understood that when reference herein is made to "one-way" coating that a coating capable of substantially blocking light transmission is contemplated. Complete blocking of light transmission in one direction is, to the inventor's knowledge, generally not possible, nor is it necessary to practice the invention.

The problem of bleeding is particularly prevalent in lights such as shown in FIGS. 2–5, wherein a reflector is used in conjunction with the bulb. Referring initially to FIG. 2, a modified form of bulb is shown at 44 in association with a parabolic reflector 46. Typically, the reflector 46 has a molded plastic housing 48 with a reflective coating 50 deposited on a forward parabolic surface 51 of the reflector 46. This coating may be aluminum, or the like, applied as a vapor in vacuum. The bulb 44 is similar to that in FIG. 1, with filaments 52, 54 operable through a control 56 similar to control 20. The bulb 44 has an additional filament 58 also connected to the control through a wire 60 and suitably grounded through a wire 62. The bulb 44 in FIG. 2 is suitable for use as a vehicle headlamp wherein filament 58 is powered for high beam operation and filament 52 is powered for low beam operation. The filament 54 projects light through a surface 64 at the forward portion of the bulb 44, which surface 64 is preferably amber so that light transmitted therethrough effectively penetrates fog, smoke, dust, etc.

The bulb 44 consists of two separate, joined parts 66, 68, each having a generally cylindrical configuration. The bulb part 66 has a cylindrical wall 70 with an inside surface 72. The forward bulb part 68 has a wall 74 with outside surface 64 having a diameter slightly less than the diameter of the inside surface 72 of the rear bulb part 66 so that the bulb part 68 can be directed into the bulb part 66 in close-fitting telescoping fashion. The outside surface 64 and inside surface 72 are in slight axial overlapping relationship at 78 and the bulb parts 66, 68 can be fused at 78 as by the use of an adhesive or other suitable connecting technique. The rearwardmost free edge 80 of the bulb part 68 provides a convenient support for mounting a disc-shaped baffle 82, which baffle 82 will not transmit light and will thus block passage of light from filaments 52, 58 through bulb surface 64 and also passage of light from filament 54 through bulb surface 84 on bulb part 66.

The two-part assembly for the bulb 44 in FIG. 2 facilitates its manufacture. The bulb parts 66, 68 can be separately formed and colored and thereafter simply assembled one with the other. This obviates the need to mask portions of the bulb when coloring is done after the formation of a single piece bulb, such as that shown in FIG. 1. The baffle 82 can be readily preassembled on the bulb part 68.

The bulb part 68 has a front wall 86 with a convex, reflective surface 88 facing the reflector 46. The surface 88 has a curvature approximating the curvature of the reflector 46 and reflects forwardly directed light rays from the filament 54 back towards the reflector 46 to increase the intensity of the produced light.

The surfaces 84 and 64 of the bulb parts 66, 68, respectively, are covered with a one-way light reflective coating 90, as in the FIG. 1 embodiment, so that light from filaments 52, 54, 58 reflecting off of the reflector 46, as indicated by arrows 92, cannot pass radially inwardly through the surfaces 84, 64 as might cause bleeding of light from one bulb part 66, 68, into and through the other bulb part 66, 68.

To permit expansion of the baffle 82, one or more ceramic insulators 93 are interposed between the outer surface 94 of the baffle 82 and the inside surface 72 of the bulb part 66.

In FIG. 3, a bulb 96 is shown as part of a vehicle headlamp with a reflector 46 having a reflective coating 50 over a parabolic forwardly opening surface 98. The principal difference between the bulb 96 and that in FIG. 2 is that the bulb 96 is constructed in one piece rather than using the two-part construction. The filaments 52, 54, 58 are connected to control 100 through conductive blades 100, 102, 104, consecutively, integrally molded into the housing 48. As in the prior embodiments, the bulb 96 has a cylindrical bulb surface 106 with a forward portion 108 and rear portion 110 to transmit different color light. A baffle 112 prevents transmission of light from filaments 52, 58 through surface portion 108 and filament 54 through surface portion 110.

The forward wall 114 of the bulb 96 is shown to be flat. While the wall 114 is preferably concave opening forwardly as shown in dotted lines 116, it can be made flat as shown in solid lines or concave opening rearwardly as shown in dotted lines 118 consistently with the invention.

As with the prior embodiments, the bulb surface 106 is coated With a one-way light reflective coating 120. The rearwardly facing surface 122 of the wall 114 at the forward portion of the bulb 96 is covered with a reflective coating to cause light from filament 54 to reflect rearwardly towards the reflector 46.

FIG. 4 shows a further modified light 124. The light 124 consists of a first bulb 126 entirely contained within a second bulb 128. The bulbs 126, 128, are used in conjunction with a reflector 46 as in the embodiment in FIGS. 2 and 3. The bulb 126 has a filament 130 and separate filaments 132, 134 are provided forwardly of the bulb 126 within the second bulb 128. The filaments 132, 134 are powered for high and low beam use respectively. The filaments 130, 132, 134 are selectively powered as in the prior embodiment by a control 136. A one-way light reflecting surface coating 138 is applied to bulb 126 and to prevent light from filaments 132, 134 from transmitting through surface 142 on bulb 126. In the FIG. 4 embodiment, the surface 142 is colored amber so that the light 124 functions effectively to penetrate fog, dust, smoke, etc. In the FIG. 4 embodiment, if the bulb 128 is clear the outer surface 144 thereof need not be coated.

In FIG. 5, two separate bulbs 146, 148 are provided in association with a reflector 46. The bulb 146 has high and low beam filaments 150, 152 respectively and bulb 148 has a filament 154. The filaments 150, 152, 154 are operated, as in the prior embodiments, by a control 156. The outer surface 158 of bulb 146 has a one-way light diffusing coating 160 to prevent transmission of light outside of the bulb through the bulb surface 158. The bulb 148 has a similar coating 160 on its outer surface 162.

With the inventive structure, multiple color lamps can be provided with projection of crisp light colors without bleeding.

What is claimed:

1. A lighting apparatus comprising:

a first source of light;

a first surface for causing light transmitted therethrough from the first source to have a first color;

a second source of light;

a second surface for causing light transmitted therethrough from the second source to have a second color; and coating means on said second surface to prevent light from the first source that is transmitted through the first surface from passing through the second surface.

2. The lighting apparatus according to claim 1 wherein a reflector is provided to direct light transmitted through the first surface by the first source toward the second surface.

3. The lighting apparatus according to claim 1 wherein said first and second colors are different.

4. The lighting apparatus according to claim 1 including a light blocking baffle and means mount the baffle between the first and second light sources to block transmission of light from said first source through said second surface and from said second source through said first surface.

5. The lighting apparatus according to claim 1 wherein said first surface is on a first bulb, said second surface is on a second bulb, said first and second bulbs each have a cylindrical portion and means mount the first and second bulbs to each other with the cylindrical portions of the first and second bulbs situated one within the other.

6. The lighting apparatus according to claim 1 wherein a bulb defines at least one of the first and second surfaces, and means are provided on the bulb to direct light from at least one of the first and second light sources back to the reflector.

7. The lighting apparatus according to claim 1 wherein means are provided to selectively power said first and second light sources.

8. A lighting apparatus with multiple color light projection capability, said lighting apparatus comprising:

a support;

a first source of light;

a first surface for causing light transmitted therethrough from the first source to have a first color;

a second source of light;

a second surface for causing light transmitted therethrough from the second source to have a second color;

means mounting the first and second light sources and first and second surfaces in fixed relative relationship on said support; and coating means on said second surface to prevent light from the first source that is transmitted through the first surface from passing through the second surface.

9. The lighting apparatus according to claim 8 wherein said support comprises a reflector with a concave reflective surface opening toward said first and second light sources.

10. The lighting apparatus according to claim 9 wherein each of said first and second surfaces is substantially cylindrical.

11. The lighting apparatus according to claim 8 wherein means are provided to selectively power said first and second light sources.

12. The lighting apparatus according to claim 8 wherein said support has a concave reflector surface opening toward said second light source, there is a bulb defining said second surface and said bulb has a reflective convex surface.

13. The lighting apparatus according to claim 12 wherein said convex reflective surface has a curvature corresponding to the curvature of the concave reflective surface to reflect light from the second source back to the concave reflective surface.

14. A lighting apparatus comprising:

a first source of light;

a first surface for causing light transmitted therethrough from the first source to have a first color;

a second source of light;

a second surface for causing light transmitted therethrough from the second source to have a second color; and coating means on said second surface to prevent light from the first source that is transmitted through the first surface from passing through the second surface, wherein said coating means comprises a coating that permits transmission of light in only one direction through said second surface.

15. A lighting apparatus with multiple color light projection capability, said lighting apparatus comprising:

a support;

a first source of light;

a first surface for causing light transmitted therethrough from the first source to have a first color;

a second source of light;

a second surface for causing light transmitted therethrough from the second source to have a second color;

means mounting the first and second light sources and first and second surfaces in fixed relative relationship on said support; and coating means on said second surface to prevent light from the first source that is transmitted through the first surface from passing through the second surface, wherein said coating means comprises a coating that permits transmission of light in only one direction through said second surface.

16. A lighting apparatus with multiple color light projection capability, said lighting apparatus comprising:

a support;

a first source of light;

a first surface for causing light transmitted therethrough from the first source to have a first color;

a second source of light;

a second surface for causing light transmitted therethrough from the second source to have a second color;

means mounting the first and second light sources and first and second surfaces in fixed relative relationship on said support; and coating means on said second surface to prevent light from the light source that is transmitted through the first surface from passing through the second surface, wherein there is a first bulb defining said first surface, a second bulb defining the second surface, each of said first and second bulbs has a cylindrical portion and said mounting means includes means mounting the cylindrical portions of the first and second bulbs in axial overlapping relationship, one with the other.

* * * * *